US010344771B2

(12) United States Patent
Lukowski et al.

(10) Patent No.: US 10,344,771 B2
(45) Date of Patent: Jul. 9, 2019

(54) TURBOMACHINE COMPONENT WITH NON-AXISYMMETRIC SURFACE

(71) Applicant: SAFRAN AIRCRAFT ENGINES, Paris (FR)

(72) Inventors: Benjamin Lukowski, Moissy-Cramayel (FR); Esteban Bernardos-Chamagne, Moissy-Cramayel (FR); Matthieu Jean Luc Vollebregt, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 341 days.

(21) Appl. No.: 15/105,453

(22) PCT Filed: Dec. 16, 2014

(86) PCT No.: PCT/FR2014/053373
§ 371 (c)(1),
(2) Date: Jun. 16, 2016

(87) PCT Pub. No.: WO2015/092263
PCT Pub. Date: Jun. 25, 2015

(65) Prior Publication Data

US 2017/0023003 A1 Jan. 26, 2017

(30) Foreign Application Priority Data

Dec. 19, 2013 (FR) ..... 13 63061

(51) Int. Cl.
*F04D 29/32* (2006.01)
*F01D 5/14* (2006.01)

(52) U.S. Cl.
CPC ..... *F04D 29/329* (2013.01); *F01D 5/143* (2013.01)

(58) Field of Classification Search
CPC ..... F04D 29/329; F01D 5/143; F01D 5/145; F01D 9/04; F05D 2200/30; F05D 2250/71; F05D 2250/712; F05D 2250/73
See application file for complete search history.

(56) References Cited

U.S. PATENT DOCUMENTS 8,152,456 B2 * 4/2012 Aubin ..... F01D 5/143 415/173.1
2002/0127108 A1 9/2002 Crall et al.
(Continued)

FOREIGN PATENT DOCUMENTS

EP 1 239 116 A2 9/2002
EP 1 995 410 A1 11/2008
EP 2 085 620 A1 8/2009

OTHER PUBLICATIONS

Weisstein, Eric W. "Bézier Curve." From MathWorld—A Wolfram Web Resource. Dec. 31, 2011 courtesy of WayBack Machine (https://archive.org/web/); http://mathworld.wolfram.com/BezierCurve.html.*

(Continued)

*Primary Examiner* — Carlos A Rivera
*Assistant Examiner* — Danielle M. Christensen
(74) *Attorney, Agent, or Firm* — Oblon, McClelland, Maier & Neustadt LLP

(57) ABSTRACT

The present invention relates to a turbomachine component (1) or collection of components comprising at least a first and a second blade (3I, 3E) and a platform (2) from which the blades (3I, 3E) extend, characterized in that the platform (2) has a non-axisymmetric surface (S) bounded by a first and a second end plane (PS, PR) and defined by at least two class C construction curves each one representing the value of a radius of said surface (S) as a function of a position between the pressure face of the first blade (3I) and the suction face of the second blade (3E) in a plane substantially (Continued)

parallel to the end planes (PS, PR), these including at least one upstream curve and one downstream curve; each construction curve being defined by at least one pressure face control end point and one suction face control end point such that: —the tangent to the downstream curve at the suction face control end point 20 is inclined by at most 5°; —any other tangent to a construction curve at a control end point is inclined by at least 5°.

20 Claims, 6 Drawing Sheets

(56) References Cited

U.S. PATENT DOCUMENTS

| | | | | |
|---|---|---|---|---|
| 2009/0053066 | A1 | 2/2009 | Iida | |
| 2009/0191049 | A1 | 7/2009 | Aubin et al. | |
| 2011/0301915 | A1* | 12/2011 | Lobato | G01B 21/04 702/167 |

OTHER PUBLICATIONS

International Search Report Written Opinion dated Mar. 19. 2015 in PCT/FR2014/053373 (with English translation of categories of cited documents).
French preliminary Search Report dated Jun. 3, 2014 in Patent Application No. 1363061.

* cited by examiner

State of the art

State of the art

TURBOMACHINE COMPONENT WITH NON-AXISYMMETRIC SURFACE

GENERAL TECHNICAL FIELD

The present invention relates to a turbomachine part comprising blades and a platform having a non-axisymmetrical surface.

STATE OF THE ART

Figure 1:
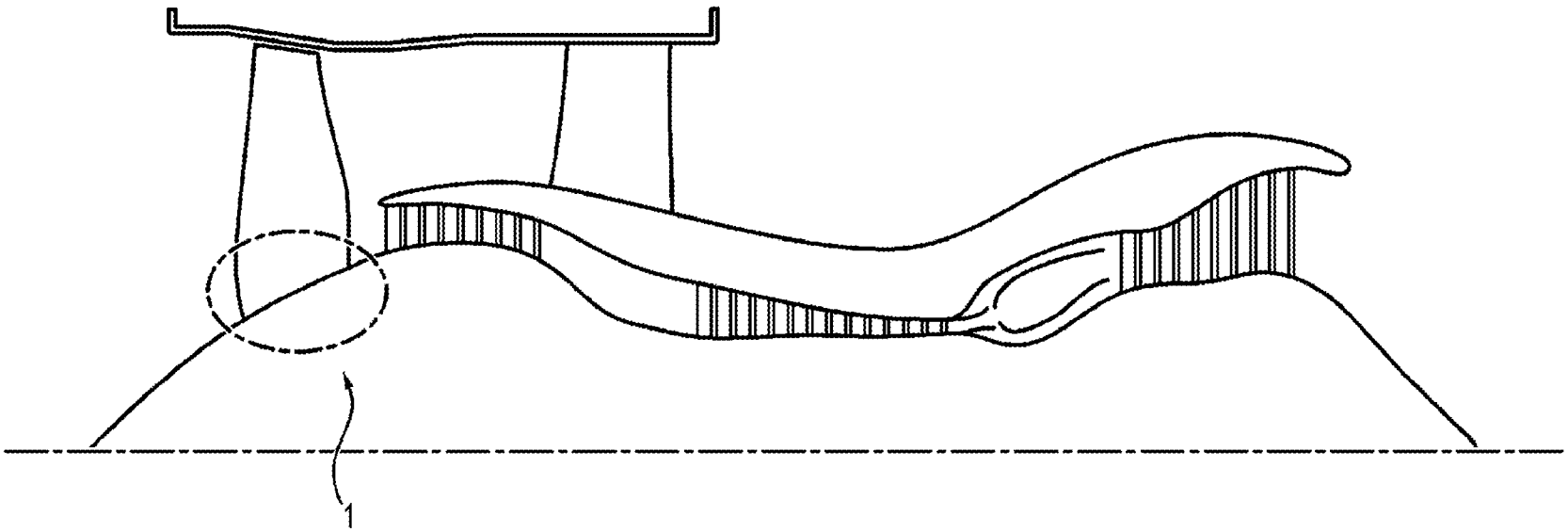

A fan, is a rotating part of a large diameter at the inlet of a dual-flow turbomachine formed with a substantially conical hub (spinner) on which are attached blades extending radially, as visible on the left of FIG. 1 (reference 1). The fan compresses a large mass of cold air, partly injected into the compressor, the remainder forming a cylindrical flow surrounding the engine and directed towards the rear for generating thrust.

The optimization of the yield and of the performances of a fan in particular requires the increase in the mass flow rate passing through the blades.

In order to increase this mass flow rate, it is possible to modify the parameters of the fan blade or else to modify the walls of the vein, i.e. the whole of the channels between the blades for the fluid flow (in other words, the inter-blade sections), in particular at the hub ("fan root", i.e. the portion of the fan which is facing the primary, the first wheel of the booster, and in other words the portion of the fan blade which will directly supply the low pressure compressor with air and which therefore forms the first mobile wheel of the latter).

Figure 2A:
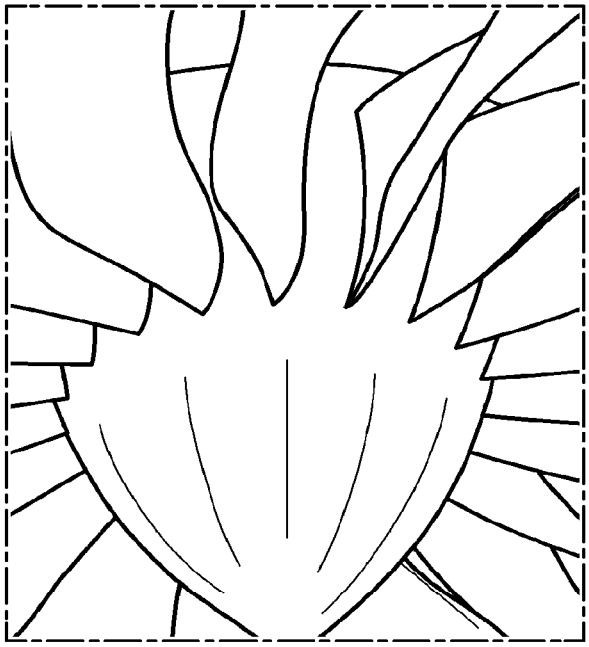

Indeed, it was observed that axisymmetrical geometries (an example of which is illustrated by FIG. 2*a*) of these walls remain able to be improved: the search for an aeromechanical geometry optimum on the "fan root" (i.e. at the base of the blades, at the junction with the hub) actually leads today to obtaining parts having a locally non-axisymmetrical wall (i.e. when a section along a plane perpendicular to the axis of rotation is not circular) at the vein, considering the particular conditions prevailing therein. The non-axisymmetrical vein defines an overall ring-shaped surface of a three-dimensional space (a "section" of the turbomachine).

Patent application EP1126132 thus proposes a non-axisymmetrical vein geometry (see FIG. 2*b*) in which the wall of a blade platform (in other words the local surface of the hub of the fan at which the blade is attached) notably has a recess extending along the blades.

However, it was found that this non-axisymmetrical vein degraded the performances of the flow through the fan. Indeed, starting from a "sound" situation of the flow with an axisymmetrical vein, the setting into place of the non-axisymmetrical vein showed according to calculations of the 3D Navier-Stokes type of significant aerodynamic detachments at the fan root on the trailing edge of the blades. Because of this negative aerodynamic effect, the performances of the fan are found to be degraded and this aerodynamic detachment was very constraining for the operability of the fan (yield, compression rate and supply of the booster notably).

It would be desirable to have a new vein geometry at the fan root which does not have the detachment problems of the state of the art and which allows for maximum yield and performances.

PRESENTATION OF THE INVENTION

The present invention thus proposes a part or a set of parts of a turbomachine comprising at least first and second blades, and a platform from which extend the blades, characterized in that the platform has a non-axisymmetrical surface limited by a first and a second end plane, and defined by at least two construction curves of class $C^1$ each representing the value of a radius of said surface according to a position between the intrados of the first blade and the extrados of the second blade along a plane substantially parallel to the end planes, including:

at least one upstream curve;

a downstream curve positioned between the first curve and a trailing edge of the first and second blades, and associated with an axial position located between 50% and 80% by length relatively to a blade chord extending from the leading edge to the trailing edge of the blade;

each construction curve being defined by at least one intrados end control point and a extrados end control point, respectively on each of the first and second blades between which said surface extends, such that:

The tangent to the downstream curve in extrados end control point is tilted by at most 5°;

Any other tangent to a construction curve in an end control point is tilted by at least 5°.

This non-axisymmetrical particular geometry of the surface of the part with a gentler slope prevents aerodynamic detachment.

The yield and the compression rate of the root of the fan are thus improved by that much.

According to other advantageous and non-limiting features:

the tangent to the downstream curve in the extrados end control point is tilted by at most 2°;

each upstream curve is associated with an axial position along the blade chord such that the curves are located at regular intervals in terms of the relative length of the blade chord;

the surface is defined by four upstream curves, including a first leading curve, a second leading curve, a first central curve and a second central curve;

the tangents to the construction curves in the end control points have tilts:

between 5° and 20° for the first leading curve;

between 10° and 30° for the second leading curve;

between 10° and 25° for the first central curve;

between 5° and 20° in the intrados end control point and between 5° and 15° in the extrados end control point for the second central curve;

between 5° and 10° in the intrados end control point for the downstream curve.

the tangents to the construction curves in the end control points have tilts:

between 10° and 15° for the first leading curve;

between 20° and 25° for the second leading curve;

between 15° and 20° for the first central curve;

between 10° and 15° in the intrados end control point and between 5° and 10° in the extrados end control point for the second central curve;

between 5° and 10° in the intrados end control point for the downstream curve;

each construction curve is further defined by a intrados intermediate control point and an extrados intermediate control point, respectively in proximity to the first and second blades between which said surface extends, and each located between the end control points of the construction curve, such that:

the extrados end and intermediate control points of the downstream curve have a difference in abscissas of at least 15 mm;

all the other extrados or intrados end and intermediate control points of a construction curve have a difference in abscissas of at most 20 mm;

the part or set of parts is such that:

all the extrados or intrados end and intermediate control points of an upstream curve have a difference in abscissas comprised between 5 and 15 mm;

the extrados end and intermediate control points of the downstream curve have a difference in abscissas comprised between 15 and 30 mm;

the intrados end and intermediate control points of the downstream curve have a difference in abscissas comprised between 5 and 15 mm;

each construction curve is entirely determined by eight parameters including:

the tilt of the tangent to the curve in the extrados end control point;

the tilt of the tangent to the curve in the intrados end control point;

the difference in abscissas between the extrados end and intermediate control points of the curve;

the difference in abscissas between the intrados end and intermediate control points of the curve;

a tension coefficient of a left half-tangent to the curve in the extrados intermediate control point;

a tension coefficient of a right half-tangent to the curve in the extrados intermediate control point or in the extrados end control point;

a tension coefficient of a left half-tangent to the curve in the intrados intermediate control point or in the intrados end control point;

a tension coefficient of a right half-tangent to the curve in the intrados intermediate control point;

each construction curve was modeled via application by data processing means of steps of:

(a) parameterization of the construction curve as a curve of class $C^1$ illustrating the value of the radius of said surface depending on a position between the intrados of the first blade and the extrados of the second blade, the curve being defined by:

two end control points, respectively on each of both blades between which said surface extends;

at least one spline;

the parameterization being applied according to one or several parameters defining at least one of the end control points;

(b) determination of optimized values of said parameters of said curve;

the part or set of parts is a fan for a dual-flow turbomachine.

According to a second aspect, the invention relates to a turbomachine comprising a part or set of parts according to the first aspect.

PRESENTATION OF THE FIGURES

Figure 2B:
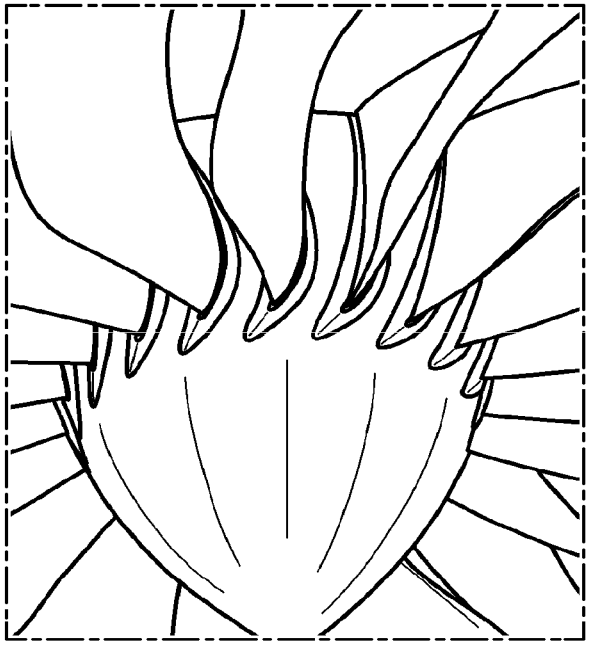
Figure 3A:
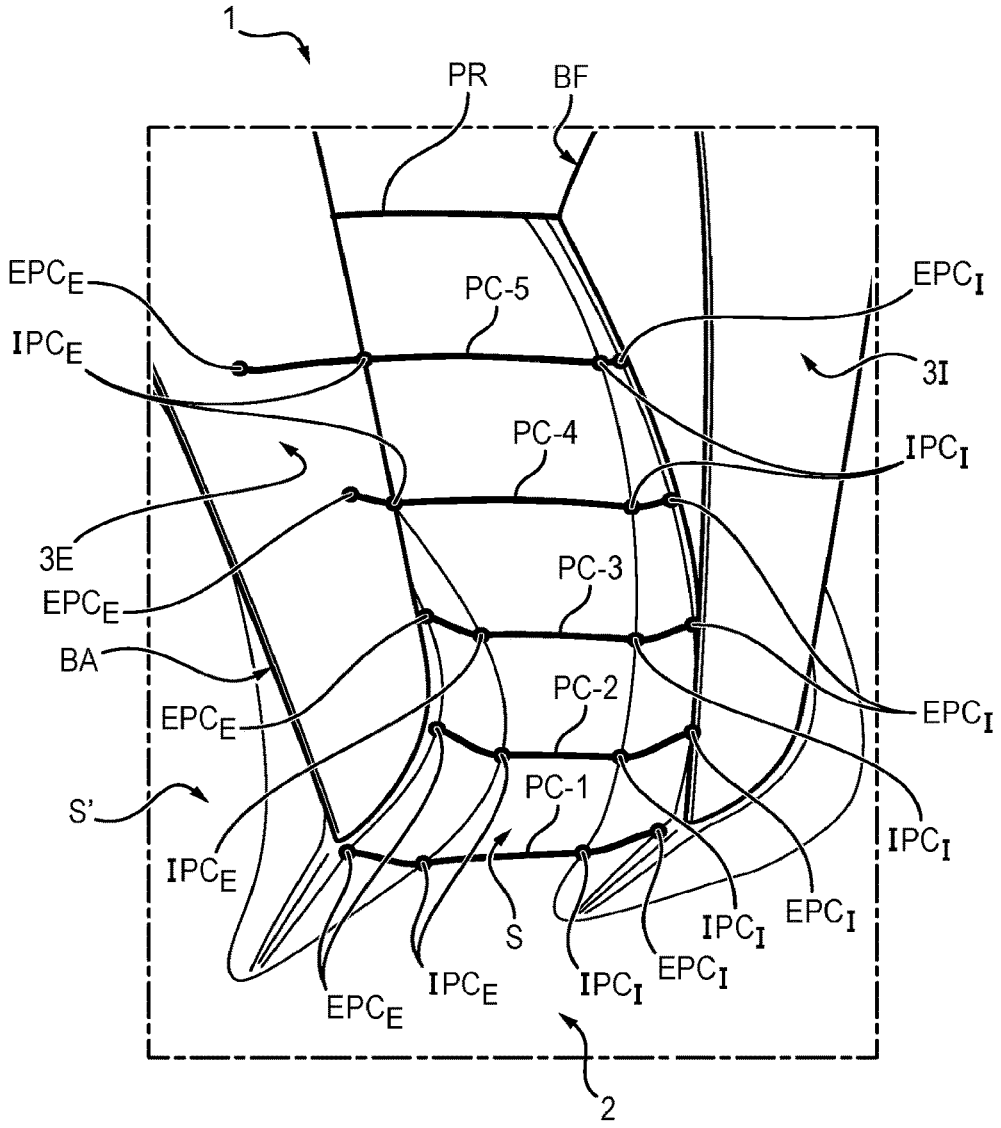
Figure 3B:
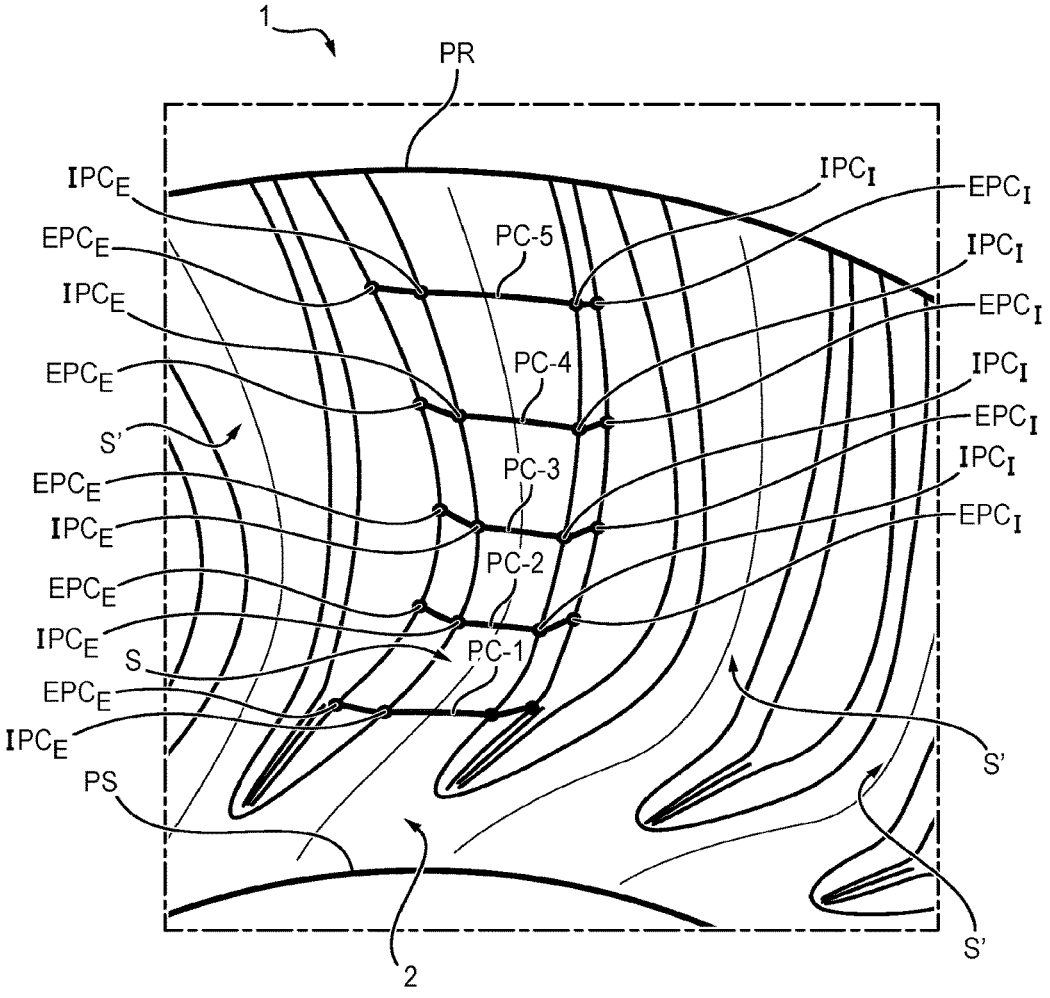
Figure 4:
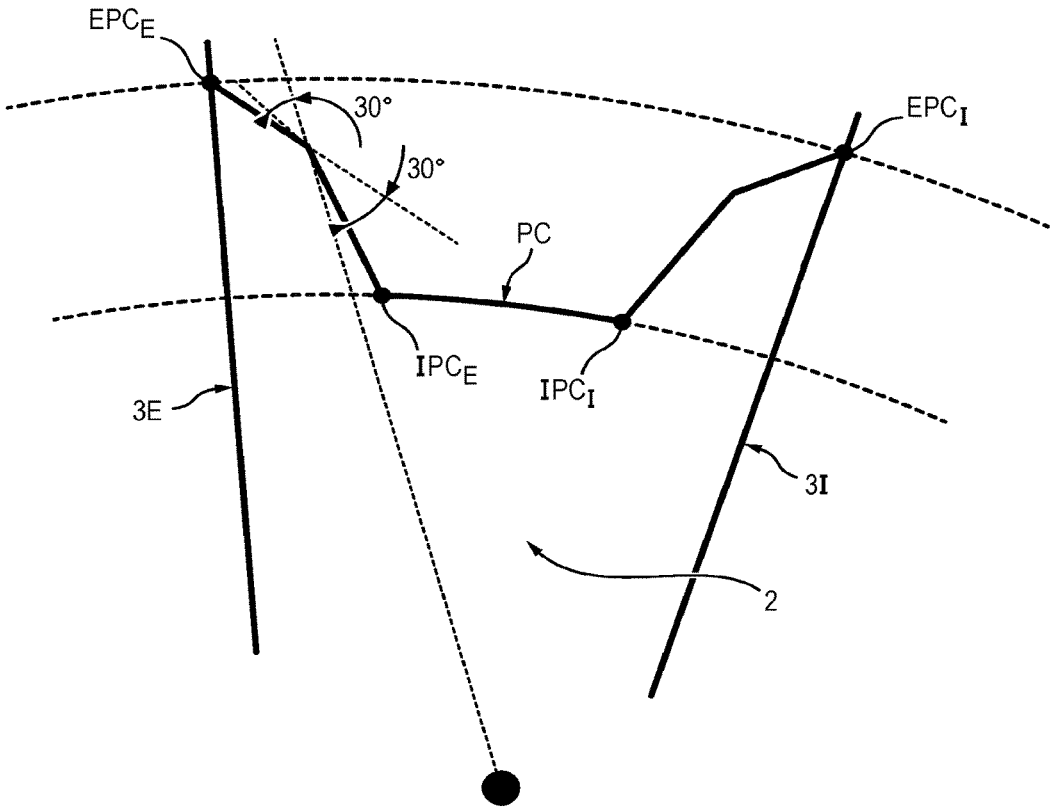
Figure 5A:
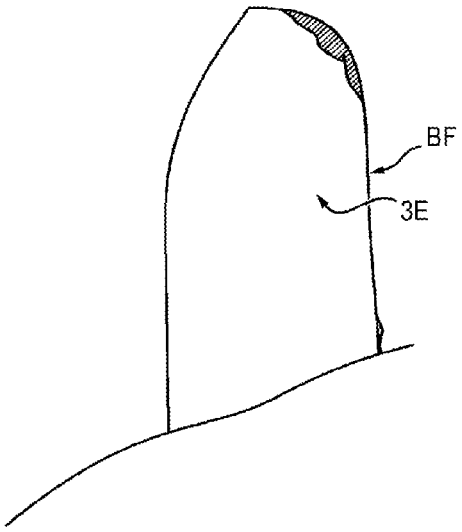
Figure 5B:
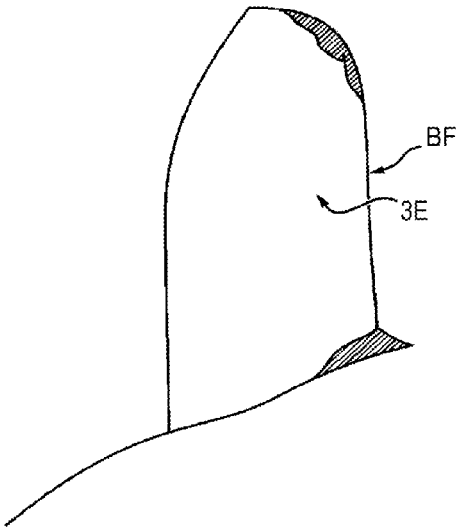
Figure 5C:
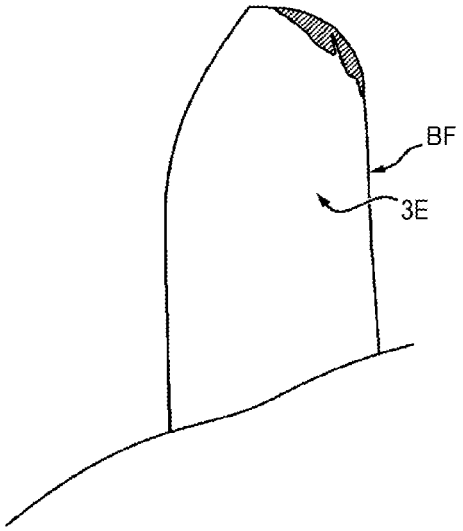

Other features and advantages of the present invention will become apparent upon reading the description which follows of a preferential embodiment. This description will be given with reference to the appended drawings wherein:

FIG. 1 described earlier illustrates an exemplary turbomachine;

FIGS. 2*a*-2*b* described earlier illustrate two known examples of fan root geometries with and without a non-axisymmetrical platform;

FIGS. 3*a*-3*b* illustrate a preferred embodiment of a part according to the invention;

FIG. 4 illustrates a preferred embodiment of a part according to the invention;

FIGS. 5*a*-5*c* illustrate the viewing of negative axial velocities for several geometries.

DETAILED DESCRIPTION

With reference to FIG. 3*a*, the present part 1 (or set of parts if it is not in one piece) of the turbomachine has at least two consecutive blades 3E, 3I and a platform 2 from which extends the blades 3E, 3I. The term of platform here is interpreted in the broad sense and generally designates any element of a turbomachine on which blades 3E, 3I may be mounted (by extending radially) and having a wall against which air circulates.

In particular, the platform 2 may be in one piece or formed with a plurality of elementary members each supporting a single blade 3E, 3I (a "root" of the blade) so as to form a vane of the type of those illustrated in FIG. 3*a*. In the illustrated example, these are "added" platforms, i.e. separated from the vanes (these are independent parts). There also exist "integrated" platforms (which will be again mentioned later on), for which each blade is bound to a "half" platform, and the junction between two neighboring platforms is then made at the middle of the vein. It will be understood that the present invention is not limited to any particular structure of the platform 2.

Further, the platform 2 delimits a radially inner wall of the part 1 (the air flows around it) by defining a hub. It will be understood that as explained, the part 1 or set of parts is advantageously a fan.

Platform Surface

The present part 1 is distinguished by a particular geometry (non-axisymmetrical) of a surface S of a platform 2 of the part 1, for which an advantageous exemplary model is observed in FIGS. 3*a* and 3*b*.

The surface S extends between two blades 3E, 3I (illustrated in FIG. 3*a*, but not in FIG. 3*b* in order to better observe the surface S. Their base is nevertheless located), which limit it tangentially.

The surface S is actually a portion of a larger surface defining a substantially torus shape around the part 1, which is here as explained the fan. Under the advantageous assumption (but non-limiting) of periodicity in the circumference of the part 1 (i.e. whether the blades 3E, 3I are identical and uniformly distributed), the wall consists of a plurality of identical surfaces duplicated between each pair of blades 3E, 3I.

The surfaces S' also visible in FIGS. 3*a* and 3*b* are thus a duplication of the surface S.

Still in this figure, a line dividing each of the surfaces S and S' into two halves is visible. This structure corresponds to an embodiment of the "integrated platforms" type as mentioned earlier, wherein the platform 2 consists of a plurality of elementary members. Each of these elementary members forms the vein at the blade root of the Fan. The blade root Fan vein thus extends on either side of the blade 3E, 3I, whence the fact that the surface S comprises juxtaposed surfaces associated with two distinct blade roots. The part 1 is thus a set of at least two juxtaposed blades (blade/vein assembly at the blade root). As already indicated, it will be understood that the present invention is not limited to any particular structure of the platform 2.

The surface S is limited upstream by a first end plane, the "Separation Plane" PS and downstream by a second end plane, the "Connection Plane" PR, which each define an axisymmetrical, continuous contour and of a continuous derivative (the curve corresponding to the intersection between each of the planes PR and PS and the surface of the part 1 on the whole is closed and forms a loop). The surface S substantially has the shape of a "parallelogram" which would have two curved sides and extend axially (along the engine axis) between both end planes PS, PR, and tangentially between both consecutive blades 3E, 3I of a blade pair. One of the blades of this blade pair is the first blade 3I, or the intrados blade. Actually it has its intrados at the surface S. The other blade is the second blade 3E, or extrados blade. It actually has its extrados at the surface S. Each "second blade" 3E is the "first blade" 3I of a neighboring surface such as the surface S' in FIG. 2 (since each blade 3E, 3I has a intrados and an extrados).

The surface S is defined by construction curves, also called "Construction Plans". At least two, advantageously three, or even four, and preferentially five (or even more) construction curves PC-1, PC-2, PC-3, PC-4, PC-5 are necessary for obtaining the geometry of the present surface S. In the continuation of the present description, the preferred example of five curves (including four "upstream" curves (a first leading curve PC-1, a second leading curve PC-2, a first central curve PC-3 and a second central curve PC-4), and a "downstream" curve PC-5), will be assumed but it will be understood that only one upstream curve from among the curves PC-1, PC-2, PC-3, PC-4 and one downstream curve PC-5 (see later on) are indispensable for defining the non-axisymmetrical surface S.

In every case, each construction curve is a curve of class $C^1$ representing the value of a radius of said surface S (a value of this variable radius, by definition, of a non-axisymmetrical platform) depending on a position between the intrados of the first blade 3I and the extrados of the second blade 3E along a plane parallel to the end planes PS, PR.

By radius is meant the distance between a point of the surface and the axis of the part 1, as for example this is seen in FIG. 4, which illustrates an example of a construction curve which will be described in more detail later on. An axisymmetrical surface thus has a constant radius by definition.

Construction Curves

As explained, the non-axisymmetrical geometries of a root blade (both the present geometry and those known from the state of the art) define a "recess" of the platform. In other words, its construction curves have a "U" shape, with 3 portions: 2 "flanks" (intrados and extrados) and the "bottom" of the non-axisymmetrical vein, which is the most recessed portion of the vein. This geometry is visible in FIG. 4.

The inventors discovered that the detachment problems of known geometries were due to the very steep "slopes" at the flanks, in particular in proximity to the trailing edge of the extrados blade. The present geometry therefore exhibits a reduced slope at this location.

The construction curves are positioned on substantially parallel planes, which form "axial" planes when they are orthogonal to the axis of the part 1. The first curve(s) PC-1, PC-2, PC-3, PC-4 are "upstream" curves, since they are positioned near the leading edge BA of the blades 3E, 3I between which it extends (even if this assembly comprises both the leading curves (located very close to the leading edge BA) and the central curves located in the intermediate portion of the blades 3I, 3E). The latter curve PC-5 is a "downstream" curve or "trailing" curve, since it is located near the trailing edge BF of the blades 3E, 3I between which it extends.

In other words, the fluid flowing in the vein successively encounters up to two leading curves and two central curves PC-1, PC-2, PC-3, PC-4, and then the downstream curve PC-5. Their positions are not fixed, but each construction curve PC-1, PC-2, PC-3, PC-4, PC-5 is in particular defined by an axial position along a chord of a blade 3E, 3I extending from the leading edge BA to the trailing edge BF of the blade 3E, 3I. It will be understood here that the logic is in terms of "axial" chord, in other words that only the axial part of the actual chord is taken into account: for example an axial position located at 0% by length relatively to the blade chord is in an axial plane passing through the leading edge BA, an axial position located at 100% by length relatively to the blade chord is in the axial plane passing through the trailing edge BF, and an axial position located at 50% by length relatively to the blade chord is in a middle axial plane of both axial planes mentioned earlier.

And in such a reference system, the downstream curve PC-5 is associated with an axial position located between 50% and 80% by length relatively to the blade chord 3E, 3I.

The upstream curve(s) PC-1, PC-2, PC-3, PC-4 is (are) associated with a position located at a length relatively to the blade chord 3E, 3I less than that of the downstream curve PC-5.

Advantageously, all the construction curves are associated with axial positions located at regular intervals along the blade chord 3E, 3I, for example every 25% in the case of four curves, or 20% in the case of five curves, so as to be able to draw the flank shapes desired by the designer of the platform (a too small number of construction curves limits the possible shapes).

Thus, in the preferred embodiment illustrated by FIGS. 3*a* and 3*b*, the first leading curve PC-1 is associated with an axial position located at 0% by length relatively to the blade chord 3E, 3I, the second leading curve PC-2 is associated with an axial position located at about 20% by length relatively to the blade chord 3E, 3I, the first central curve PC-3 is associated with an axial position located at about 40% by length relatively to the blade chord 3E, 3I, the second central curve PC-4 is associated with an axial position located at about 60% by length relatively to the blade chord 3E, 3I, and the downstream curve PC-5 is associated with an axial position located at about 80% by length relatively to the blade chord 3. However, it will be understood that the upstream curves PC-1, PC-2, PC-3, PC-4 may be positioned anywhere on the front portion of the vein.

As this is still seen in FIGS. 3*a* and 3*b*, each curve has a specific geometry designed for limiting the slope at the trailing edge BF, in particular the downstream curve PC-5.

Each construction curve PC-1, PC-2, PC-3, PC-4, PC-5 is typically a spline consisting of 3 portions: The 2 flanks and the bottom of the vein, as mentioned earlier.

Splines are parametric polynomial curves, from which preferentially Bezier curves may be mentioned defined as combinations of N+1 elementary polynomials so-called Bernstein Polynomials: a Bezier curve is defined by the set of points $\Sigma_{i=0}^{N} B_i^N(t) \cdot P_i$, $t \in [0,1]$, the $$B_i^N(t) = \binom{N}{i} t^N (1-t)^{N-i}$$

being the N+1 Bernstein polynomials of degree N.

The points $\{P_0, P_1 \ldots P_N\}$ are called "implicit" control points of the curve and are the variables by which a construction curve may be parametrized.

These points are designated as "implicit" because a Bezier curve may be considered as the set of barycentres of N+1 weighted control points with a weight equal to the value of the Bernstein polynomial associated with each control point. In other words, these points act as localized weights generally attracting the curve without it passing through them (except for the first and the last, respectively corresponding to t=0 and t=1, and in certain cases alignment of points).

Each construction curve PC-1, PC-2, PC-3, PC-4, PC-5 is thus defined by at least one intrados end control point $EPC_I$ and a extrados end control point $EPC_E$, on each of the first and second blades 3I, 3E respectively between which said surface S extends. As this will be seen later on, each construction curve PC-1, PC-2, PC-3, PC-4, PC-5 is further advantageously defined by a intrados intermediate control point $IPC_I$ and a extrados intermediate control point $IPC_F$, respectively in proximity to the first and second blades 3I, 3E between which said surface S extends, and each located between the end control points of the construction curve PC-1, PC-2, PC-3, PC-4, PC-5. This definition of a curve with four points gives the possibility of generating U-shaped geometries which are seen in the figures, and in particular in FIG. 4.

The parameter(s) defining a control point are thus selected from among an abscissa of the point, an ordinate of the point, an orientation of the tangent to the curve at the point and one (in the case of an end control point, it cannot be taken into account that the half-tangent in the range of definition of the curve, on the left or on the right depending on the point) or two (in the case of an intermediate control point) tension coefficients each associated with a half-tangent to the curve at the point.

The positions of the end control points are constrained by the blades 3. On the other hand, the orientations of the tangent to the curve in these points (in other words, the derivatives) allow control of the slopes of the surface S. The curves are thus such that:

- the tangent to the downstream curve PC-5 in the extrados end control point is tilted by at most 5°;
- any other tangent to an upstream curve PC-1, PC-2, PC-3, PC-4, or even any other tangent to a construction curve PC-1, PC-2, PC-3, PC-4, PC-5 (in other words, including tangent to the downstream curve PC-5 at the intrados end control point) in an end control point is tilted by at least 5° (and advantageously at most 30°).

The tangent to the downstream curve PC-5 in the extrados end control point is even if possible tilted by at most 2°. This pronounced dissymmetry of the downstream curve PC-5 is expressed by gradual return and over a larger distance to a quasi axisymmetrical geometry on the last portion of the vein, which limits or even suppresses the aerodynamic detachment. Indeed, this gradual return to an axisymmetrical vein limits the curvature effect and therefore limits the too sudden slowing down of the fluid.

Further, at least one upstream curve PC-1, PC-2, PC-3, PC-4 has tangents in its end control points tilted by at least 20°. In the case of four upstream curves, this is the second leading curve PC-2 (which thus has the strongest tilts of all the construction curves).

As regards the tangent to the downstream curve PC-5 in the intrados end control point, it is also limited in particular to 10°. Thus, even if its tilt is greater than that of tangent to the downstream curve PC-5 in the extrados end control point, it remains small, unlike what is sometimes encountered for compressor veins (see patent application EP 2 085 620), wherein this angle tends towards 90° (vertical tangent) at the vein output.

Preferably, any tangent to an upstream curve PC-1, PC-2, PC-3, PC-4 in the intrados end control point is more tilted than the tangent to the downstream curve PC-5 in the intrados end control point. In particular, the intrados tilt may be decreasing by covering the vein (while it is known that it is increasing), or creasing and then decreasing.

In the latter preferred case, at least two upstream curves PC-1, PC-2, PC-3, PC-4 are such that the tilt of the tangents to each construction curve PC-1, PC-2, PC-3, PC-4, PC-5 in the intrados end control point increases and then decreases while covering the construction curves PC-1, PC-2, PC-3, PC-4, PC-5 from the leading edge (BA) to the trailing edge of the blade 3I, 3E. In other words, the maximum tilt of the tangent in the intrados end control point is attained for a curve other than the first leading curve PC-1 and the downstream curve PC-5. In practice, this maximum is attained at the second leading curve PC-2 (see later on).

The same thing is advantageously valid for the extrados tilt which may be decreasing while covering the vein, or preferably creasing and then decreasing the tilt of the tangents to each construction curve PC-1, PC-2, PC-3, PC-4, PC-5 in the extrados end control point increases and then decreases while covering the construction curves PC-1, PC-2, PC-3, PC-4, PC-5 from the leading edge BA to the trailing edge of the blade 3I, 3E, with a maximum optionally at the second leading curve PC-2.

With reference to FIGS. 3*a* and 3*b*, the tangents to the construction curves in the end control points preferably have the following tilts:

- between 5° and 20° and advantageously between 10° and 15° for the first leading curve PC-1;
- between 10° and 30° and advantageously between 20° and 25° for the second leading curve PC-2;
- between 10° and 25° and advantageously between 15° and 20° for the first central curve PC-3;
- between 5° and 20° and advantageously between 10° and 15° in the intrados end control point; and between 5° and 15° and advantageously between 5° and 10° in the extrados end control point for the second central curve PC-4 (this gradual lowering of the tilt on the extrados gives the possibility of reducing the overall slope of the vein in order to reduce or even suppress the risks of detachment at the root of the vane at the trailing edge BF);
- between 5° and 10° in the intrados end control point and about 1° in the extrados end control point for the downstream curve PC-5.

Each construction curve PC-1, PC-2, PC-3, PC-4, PC-5 is in particular defined all in all by eight parameters from among all the aforementioned parameters. In addition to the tilt of the tangent in each of the end control points (two parameters), the abscissa of each of the intermediate control points (two parameters) and the tension coefficient associated with each of the half-tangents in each of the intermediate and/or end control points (four parameters from among six possible half-tangents) are found.

In practice, as this is seen in FIG. 4, the four last parameters are the tension coefficient of a left half-tangent to the curve in the extrados intermediate control point, the tension coefficient of a right half-tangent to the curve in the extrados end control point, the tension coefficient of a left half-tangent to the curve in the intrados end control point, and the tension coefficient of a right half-tangent to the curve in the intrados intermediate control point.

All the tension coefficients associated with a half-tangent in a control point may be equal over the whole of the construction curves PC-1, PC-2, PC-3, PC-4, PC-5.

As regards the abscissas of the intermediate control points, they allow definition of the length of the flanks of the "U" formed by each curve. They are such that:

- the extrados end and intermediate control points of the downstream curve PC-5 have a difference in abscissas of at least 15 mm;
- all the other extrados or intrados end and intermediate control points of a construction curve PC-1, PC-2, PC-3, PC-4, PC-5 (therefore including the intrados end and intermediate control points of the downstream curve PC-5) have a difference in abscissas of at most 20 mm, and advantageously at most 15 mm.

The fact that the flank of the U is elongated at the extrados trailing edge BF gives the possibility of further making the slope gentle and therefore further limiting the detachment effects at the vane root.

With reference to FIGS. 3*a* and 3*b*, preferably:

- all the extrados or intrados end and intermediate control points of an upstream curve PC-1, PC-2, PC-3, PC-4 have a difference in abscissas comprised between 5 and 15 mm, and advantageously between 10 and 15 mm;
- the extrados end and intermediate control points of the downstream curve PC-5 have a difference in abscissas comprised between 15 and 25 mm, and advantageously between 15 and 20 mm;
- the intrados end and intermediate control points of the downstream curve PC-5 have a difference in abscissas comprised between 5 and 15 mm, advantageously between 5 and 10 mm.

Modelling of the Surface

The definition of the surface via the two to five construction curves PC-1, PC-2, PC-3, PC-4, PC-5 then facilitates automatic optimization of the non-axisymmetrical vein and therefore of the part 1.

Each construction curve PC-1, PC-2, PC-3, PC-4, PC-5 may thus be modeled via the application of steps for:

(a) parameterization of the construction curve PC-1, PC-2, PC-3, PC-4, PC-5 as a curve of class $C^1$ representing the value of the radius of said surface S depending on a position between the intrados of the first blade 3I and the extrados of the second blade 3E, the curve being defined by:
  - two end control points, respectively on each of both blades 3E, 3I, between which said surface S extends (and advantageously two intermediate control points, respectively in proximity to the two blades 3I, 3E, and each located between the end control points);
  - at least one spline;
  - the parameterization being applied according to one or several parameters defining at least one of the end control points (advantageously all or part of the eight parameters mentioned earlier);

(b) determination of optimized values of said parameters of said curve.

These steps are carried out with a piece of computer equipment comprising data processing means (for example a supercomputer applying a CAO software package).

Certain parameters of the end or intermediate control points, for example the tilt intervals of the tangents, are set so as to observe the sought slope conditions.

Many criteria may be selected as criteria to be optimized during the modeling of each curve. As an example, it is possible to attempt maximization of the mechanical properties such as the resistance to mechanical stresses, the frequency responses, the displacements of the blades 3E, 3I, aerodynamic properties such as the yield, the pressure increase, the flow capacity, or the margin upon pumping, etc.

For this, it is necessary to parameterize the law which one seeks to optimize, i.e. make out of it a function of N input parameters. The optimization then consists of varying (generally randomly) these different parameters under a constraint, until their optimum values are determined for a predetermined criterion. A "smoothed" curve is then obtained by interpolation from determined passage points.

The number of required computations is then directly related to the number of input parameters of the problem. Indeed, most often, the number of computations for a proper response surface is of two to the power of the number of parameters.

Many methods are known, but preferably a method similar to the one described in patent application FR1353439 will be applied, which allows excellent modelling quality, without high consumption of computing power, while limiting the Runge phenomenon (excessive "ripple" of the surface).

It should be noted that the blade 3E, 3I is attached to the platform 2 via a connecting curve (for example visible in FIG. 2*b*), which may be the object of specific modeling notably also via the use of splines and user control points.

Effect of these Geometries

Analyses tests of negative axial velocities (characteristics of detachment phenomena) along the extrados blade 3E were conducted for three geometries: an axisymmetrical geometry (FIG. 5*a*), a non-axisymmetrical geometry according to the state of the art (FIG. 5*b*) and the present non-axisymmetrical geometry (FIG. 5*c*).

It is clearly seen in FIG. 5*b*, the occurrence of a "pocket" with a negative axial velocity at the trailing edge BF, representative of a detachment phenomenon.

On the contrary, in FIG. 5*c* this phenomenon has practically disappeared and one returns to the flow quality of an axisymmetrical geometry (FIG. 5*a*).

The invention claimed is:

1. A part or a set of parts of a turbomachine comprising:
- at least first and second blades; and
- a platform from which extends the blades,
- wherein the platform has a nonaxisymmetrical surface limited by a first end plane and a second end plane, and defined by construction curves of class $C^1$ each representing a value of a radius of said surface depending on a position between an intrados of the first blade and an extrados of the second blade along a plane substantially parallel to the end planes, including:
  - at least two upstream curves; and
  - a downstream curve positioned between the upstream curves and a trailing edge of the first and second blades, and associated with an axial position located between 50% and 80% by length relative to a blade chord extending from a leading edge to the trailing edge of a blade of the first and second blades;
- each construction curve being defined by at least one intrados end control point and extrados end control point, respectively on each of the first and second blades between which said surface extends, such that:
  - a tangent to the downstream curve in the extrados end control point is tilted by at most 5°;
  - a tangent to the downstream curve in the intrados end control point is tilted by at most 10°;
  - any tangent to an upstream construction curve in an end control point is tilted by at least 5°; and a tilt of the tangents to each construction curve in the extrados end control point increases and then decreases while covering the construction curves from the leading edge to the trailing edge of the blade.

2. The part or set of parts according to claim 1, wherein the tangent to the downstream curve in the extrados end control point is tilted by at most 2°, and the tangent to the downstream curve in the intrados end control point is tilted by at least 5°.

3. The part or set of parts according to claim 1, wherein each upstream curve is associated with an axial position along the blade chord such that the construction curves are located at regular intervals in terms of a relative length of the blade chord.

4. The part or set of parts according to claim 1, wherein any tangent to an upstream curve in the intrados end control point is more tilted than the tangent to the downstream curve in the intrados end control point.

5. The part or set of parts according to claim 1, wherein the surface is defined by the at least two upstream curves such that a tilt of the tangents to each construction curve in the intrados end control point increases and then decreases while covering the construction curves from the leading edge to the trailing edge of the blade.

6. The part or set of parts according to claim 1, wherein the surface is defined by four upstream curves, including a first leading curve, a second leading curve, a first central curve and a second central curve.

7. The part or set of parts according to claim 6, wherein the tangents to the construction curves in the end control points have tilts:

between 5° and 20° for the first leading curve;

between 10° and 30° for the second leading curve;

between 10° and 25° for the first central curve;

between 5° and 20° in the intrados end control point and between 5° and 15° in the extrados end control point for the second central curve; and between 5° and 10° in the intrados end control point for the downstream curve.

8. The part or set of parts according to claim 7, wherein the tangents to the construction curves in the end control points have tilts:

between 10° and 15° for the first leading curve;

between 20° and 25° for the second leading curve;

between 15° and 20° for the first central curve;

between 10° and 15° in the intrados end control point and between 5° and 10° in the extrados end control point for the second central curve; and between 5° and 10° in the intrados end control point for the downstream curve.

9. The part or set of parts according to claim 1, wherein each construction curve is further defined by an intrados intermediate control point and an extrados intermediate control point, respectively in proximity to the first and second blades between which said surface extends, and each located between the end control points of the construction curve, such that:

the extrados end and intermediate control points of the downstream curve have a difference in abscissas of at least 15 mm; and all the other extrados or intrados end and intermediate control points of a construction curve have a difference in abscissas of at most 20 mm.

10. The part or set of parts according to claim 9, wherein:

all the extrados or intrados end and intermediate control points of an upstream curve have a difference in abscissas comprised between 5 and 15 mm;

the extrados end and intermediate control points of the downstream curve have a difference in abscissas comprised between 15 and 30 mm; and the intrados end and intermediate control points of the downstream curve have a difference in abscissas comprised between 5 and 15 mm.

11. The part or set of parts according to claim 9, wherein each construction curve is entirely determined by eight parameters including:

the tilt of the tangent to the construction curve in the extrados end control point;

the tilt of the tangent to the construction curve in the intrados end control point;

the difference in abscissas between the extrados end and intermediate control points of the construction curve;

the difference in abscissas between the intrados end and intermediate control points of the construction curve;

a tension coefficient of a left half-tangent to the construction curve in the extrados intermediate control point;

a tension coefficient of a right half-tangent to the construction curve in the extrados intermediate control point or in the extrados end control point;

a tension coefficient of a left half-tangent to the construction curve in the intrados intermediate control point or in the intrados end control point; and a tension coefficient of a right half-tangent to the construction curve in the intrados intermediate control point.

12. The part or set of parts according to claim 1, for which each construction curve was modeled via an application by data processing of steps including:

(a) parameterization of the construction curve as a curve of class $C^1$ representing the value of the radius of said surface depending on a position between the intrados of the first blade and the extrados of the second blade, the curve being defined by:

two end control points, respectively on each of both blades between which said surface extends; and at least one spline;

the parameterization being applied according to one or several parameters defining at least one of the end control points; and (b) determination of optimized values of said parameters of said curve.

13. The part or set of parts according to claim 1, being a fan for a dual-flow turbomachine.

14. A turbomachine comprising the part or set of parts according to claim 1.

15. A part or a set of parts of a turbomachine comprising:

at least first and second blades; and a platform from which extends the blades, wherein the platform has a non-axisymmetrical surface limited by a first end plane and a second end plane, and defined by construction curves of class $C^1$ each representing a value of a radius of said surface depending on a position between an intrados of the first blade and an extrados of the second blade along a plane substantially parallel to the end planes, including:

at least two upstream curves; and a downstream curve positioned between the upstream curves and a trailing edge of the first and second blades, and associated with an axial position located between 50% and 80% by length relative to a blade chord extending from a leading edge to the trailing edge of a blade of the first and second blades;

each construction curve being defined by at least one intrados end control point and extrados end control point, respectively on each of the first and second blades between which said surface extends, such that:

a tangent to the downstream curve in the extrados end control point is tilted by at most 5°;

a tangent to the downstream curve in the intrados end control point is tilted by at most 10°;

any tangent to an upstream construction curve in an end control point is tilted by at least 5°; and a tilt of the tangents to each construction curve in the intrados end control point increases and then decreases while covering the construction curves from the leading edge to the trailing edge of the blade.

16. The part or set of parts according to claim 15, being a fan for a dual-flow turbomachine.

17. A turbomachine comprising the part or set of parts according to claim 15.

18. A part or a set of parts of a turbomachine comprising: at least first and second blades; and a platform from which extends the blades, wherein the platform has a non-axisymmetrical surface limited by a first end plane and a second end plane, and defined by at least two construction curves of class $C^1$ each representing a value of a radius of said surface depending on a position between an intrados of the first blade and an extrados of the second blade along a plane substantially parallel to the end planes, including:

at least one upstream curve; and a downstream curve positioned between the upstream curve and a trailing edge of the first and second blades, and associated with an axial position located between 50% and 80% by length relative to a blade chord extending from a leading edge to the trailing edge of a blade of the first and second blades;

each construction curve being defined by at least one intrados end control point and extrados end control point, respectively on each of the first and second blades between which said surface extends, such that:

a tangent to the downstream curve in the extrados end control point is tilted by at most 5°;

a tangent to the downstream curve in the intrados end control point is tilted by at most 10°; and any tangent to an upstream construction curve in an end control point is tilted by at least 5°;

wherein each construction curve was modeled via an application by data processing of steps including:

(a) parameterization of the construction curve as a curve of class $C^1$ representing the value of the radius of said surface depending on a position between the intrados of the first blade and the extrados of the second blade, the curve being defined by:

two end control points, respectively on each of both blades between which said surface extends; and at least one spline;

the parameterization being applied according to one or several parameters defining at least one of the end control points; and (b) determination of optimized values of said parameters of said curve.

19. The part or set of parts according to claim 18, being a fan for a dual-flow turbomachine.

20. A turbomachine comprising the part or set of parts according to claim 18.

* * * * *